US006224414B1

(12) United States Patent
Fukuda

(10) Patent No.: US 6,224,414 B1
(45) Date of Patent: May 1, 2001

(54) HALF-FITTING PREVENTION CONNECTOR

(75) Inventor: Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/422,342

(22) Filed: Oct. 21, 1999

(30) Foreign Application Priority Data

Oct. 22, 1998 (JP) ..... 10-301269

(51) Int. Cl.[7] ..... H01R 13/627
(52) U.S. Cl. ..... 439/352
(58) Field of Search ..... 439/350–358

(56) References Cited

U.S. PATENT DOCUMENTS 5,820,399 * 10/1998 Shirouzu et al. ..... 439/352
6,059,597 * 5/2000 Endo et al. ..... 439/352

FOREIGN PATENT DOCUMENTS 195 14 842 A1 10/1996 (DE) .
197 33 893 A1 2/1999 (DE) .
5-81967 11/1993 (JP) .
10-50408 2/1998 (JP) .

* cited by examiner

*Primary Examiner*—Hien Vu
(74) *Attorney, Agent, or Firm*—Sughrue, Mion, Zinn, Macpeak & Seas, PLLC

(57) ABSTRACT

In a half-fitting prevention connector, a half-fitted condition of female and male connectors is prevented by a resilient force of compression springs received in a housing of the female connector, and a slider (10) is received in the housing, and when the female connector is to be fitted relative to the male connector, the slider cooperates with the compression springs to move in the housing. A housing of the male connector includes a completely-retaining projection (45) for retaining a housing lock (47) of a lock arm (46), and a provisionally-retaining projection (41) for retaining the housing lock (47) with a retaining force smaller than that of the completely-retaining portion (45), and the completely-retaining and provisionally-retaining projections are juxtaposed to each other in a direction of a width of the housing. The slider (10) includes an arm correcting portion (51) which corrects the inclination of the lock arm (46) in a direction of a width of the housing when the slider is moved to a lock position, thereby displacing the housing lock (47) to the completely-retaining projection (45).

5 Claims, 16 Drawing Sheets

HALF-FITTING PREVENTION CONNECTOR

BACKGROUND OF THE INVENTION

1. Field of the Invention

The present invention relates to a half fitting-prevention connector in which a half-fitted condition is positively prevented by a resilient force of a spring member mounted in at least one of a pair of connectors to be fitted and connected together, and the connector, fitted on the mating connector, is positively locked.

The present application is based on Japanese Patent Application No. Hei. 10-301269, which is incorporated herein by reference.

2. Description of the Related Art

Usually, various electronic equipments are mounted on a vehicle such as an automobile, and therefore, naturally, various types of female and male connectors are provided at connection ends of various kinds of wires forming wire harnesses or the like.

Various half-fitting prevention connectors, in which a condition of fitting between female and male connectors, can be detected, have been used, and one such example is disclosed in Unexamined Japanese Utility Model Publication No. Hei. 5-81967.

This half-fitting prevention connector comprises a pin-type connector, having a plurality of juxtaposed pin contacts mounted therein, and a socket-type connector having a plurality of juxtaposed socket contacts mounted therein. A movable cover is mounted on the outer periphery of the female connector for movement back and forth. Spring receiving portions are provided at opposite side portions of this movable cover, respectively, and spring member are received respectively in these spring receiving portions, and extend in a forward-rearward direction.

In this half-fitting prevention connector, however, although the half-fitted condition can be prevented by the resilient force of the compression springs, there is encountered a problem that when trying to fit the two connectors together while holding the opposite side surfaces of the movable cover with the hand, the movable cover can not be moved, and therefore the efficiency of the fitting operation is low.

A connector fitting construction for solving the above problem has been proposed by Unexamined Japanese Patent Publication No. Hei. 10-50408 and so on.

A female connector 1A (one of two connectors of the half-fitting prevention connector shown in FIG. 13), comprises a housing 3 which includes a connector housing 3*a*, having a terminal receiving chamber, and an exclusive-use housing (slider housing) 3*b* formed above the connector housing 3*a*, the exclusive-use housing 3*b* forming a slider receiving portion 4 for slidably receiving a slider 10A (described later). Guide grooves 5 for respectively guiding opposite side portions of a body of the slider 10A are formed respectively in opposite side portions of the exclusive-use housing 3*b*, and a spring receiving portion 3*c* of a tubular shape is formed at a rear end of each of the guide grooves 5.

A lock arm 6 is formed integrally with the exclusive-use housing 3*b* at a widthwise central portion thereof, and extends in a fitting direction, the lock arm 6 having an elastic, free end portion. The lock arm 6 has a lock beak 7 formed on an upper surface thereof, and the lock beak 7 has a slanting surface, and a housing lock 8 for retaining engagement with the mating connector is formed on a lower surface of the lock arm at a distal end thereof. Displacement prevention projections 8*a* for preventing the displacement of the lock arm 6 are formed on the upper surface of the lock arm 6, and face away from the housing lock 8. Side spaces 4*a* for receiving part of the slider 10A are formed at opposite sides of the lock arm 6, respectively.

The slider 10A includes an elastic slider arm 12 provided at a generally central portion of the slider body 11, and the slider arm 12 has a pair of abutment projections 14 formed respectively at opposite side portions of a lower surface thereof at a front end thereof. The slider includes a pressing portion 15, which is formed on an upper surface thereof at a rear end thereof, and is operated when canceling the fitting connection, and a slide groove 13 formed in the slider arm 12 and the pressing portion 15. Spring retaining portions 16 for respectively retaining compression springs (spring members) 9 are formed respectively at opposite side portions of a lower portion of the slider body 11 at the rear end thereof. A displacement prevention portion 17 for preventing the displacement of the lock arm 6 is formed at the front end of the slider body 11.

As shown in FIG. 14, the male connector (the other connector) 2A includes a housing 21 having a terminal receiving chamber, a pair of stopper projections 22A, which are formed on a surface of the housing 21 so as to abut respectively against the abutment projections 14 of the slider 10A during the connector-fitting operation, a slanting projection 23, which is provided between the stopper projections 22A, and has a slanting surface for flexing the lock arm 6, and an engagement groove 24 which is formed at a rear side of the slanting projection 23 so as to be engaged with the housing lock 8 of the lock arm 6 when the housing lock 8 slides over the slanting projection 23.

When the slider 10A, having the compression springs 9 held respectively on the spring retaining portions 16, is pushed into the slider receiving portion 4 of the female connector 1A from the front side thereof as shown in FIG. 13, the slider body 11 moves along the guide grooves 5 toward the rear end of the female connector. At this time, the abutment projections 14, formed at the lower surface of the slider arm 12, are received respectively in the side spaces 4*a* formed respectively at the opposite sides of the lock arm 6. Then, the compression springs 9 are received in the spring receiving portions 3*c*, respectively, and the lock beak 7 is fitted in the slide groove 13, so that the slider 10A is held on the housing 3 for movement between a lock position and a non-lock position. In the non-lock position (which is near to the proximal end of the lock arm 6) of the slider 10A, the slider 10A allows the lock arm 6 to be elastically deformed when the lock arm 6 is brought out of engagement with the mating housing. In the lock position (which is near to the distal end of the lock arm) of the slider 10A, the slider 10A prevents the elastic deformation of the lock arm 6.

In the slider-mounted condition, the slider 10A is urged forward (i.e., toward the lock position) by the resilient force of the compression springs 9 as shown in FIG. 14, and the front end of the pressing portion 15 is retainingly held against the lock beak 7 in the slide groove 13, and the displacement prevention projections 8*a*, formed at the distal end of the lock arm 6, abut against the displacement prevention portion 17 formed on the lower surface of the slider 10A at the front end thereof, thereby preventing the upward elastic deformation of the lock arm 6.

Then, when the operation for fitting the female and male connectors 1A and 2A together is started as shown in FIG. 14, the stopper projections 22A of the male connector 2A are inserted respectively into the side spaces 4*a* (see FIG. 13), formed respectively at the opposite sides of the lock arm 6 of the female connector 1A, and these stopper projections 22A abut against the abutment projections 14 of the slider 10A, respectively. From this time on, the resilient force of the compression springs 9 is produced. At this stage, pin contacts 31, mounted in the male connector 2A, are not yet fitted respectively in socket contacts 30 mounted in the female connector 1A.

Then, when the fitting operation further proceeds, the slider 10A is pushed rearward (right in FIG. 15) against the bias of the compression springs 9, so that the housing lock 8, formed at the distal end of the lock arm 6, abuts against the slanting projection 23 of the male connector 2A. If the pushing operation is stopped in this half-fitted condition, the female and male connectors 1A and 2A are returned or moved away from each other (that is, in a disconnecting direction opposite to the fitting direction) by the resilient force of the compression springs 9, and therefore such half-fitted condition can be easily detected.

Then, when the fitting operation further proceeds as shown in FIG. 15, the slider arm 12 of the slider 10A is flexed (elastically deformed) upwardly by the lock beak 7, so that the abutting engagement of the stopper projections 22A with the abutment projections 14 of the slider 10A is canceled. Then, the housing lock 8, formed at the distal end of the lock arm 6, slides over the slanting projection 23, and is engaged in the engagement groove 24, and also the slider arm 12, disengaged from the stopper projections 22A, is returned to the lock position by the resilient force of the compression springs 9.

When the slider 10A is returned to the lock position under the influence of the compression springs 9, the displacement prevention portion 17 of the slider 10A abuts against the displacement prevention projections 8*a* of the lock arm 6, as shown in FIG. 16. As a result, the lock arm 6 is prevented from elastic deformation, and the cancellation of engagement of the lock arm 6 in the engagement groove 24 is prevented by the slider 10A, thus achieving a double-locked condition. In this condition in which the cancellation of the engagement of the lock arm 6 is prevented by the slider 10A, the female and male connectors are held in a completely-fitted condition, and the contacts 30 are completely connected to the contacts 31, respectively.

This completely-fitted condition can be detected through the sense of touch, obtained when the housing lock 8 of the lock arm 6 slides over the slanting projection 23, and also can be easily detected by viewing the position of the returned slider 10A.

However, in the above connector fitting construction in which the female and male connectors 1A and 2A can be fitted together, even when the housing lock 8 of the lock arm 6 slides over the slanting projection 23 of the mating connector 2A, and becomes engaged with the mating connector, the slider 10A sometimes fails to be returned to the lock position, for example, because of a variation in the manufacturing tolerance, and in such a case, there is encountered an incompletely-fitted condition in which the double-locked condition (in which the cancellation of the engagement of the lock arm 6 is prevented by the slider 10A) can not be achieved.

Therefore, if there occurs such an incompletely-fitted condition in which the slider 10A can not be completely returned to the lock position, the two connectors must be spaced apart (that is, disconnected) from each other by the resilient force of the compression springs 9 in such a manner that the contacts in the two connectors are not electrically connected to each other, thereby telling the operator of this incompletely-fitted condition.

Namely, if the double-locked condition can not be achieved, the engagement of the lock arm 6 must be canceled so as to move the half-fitted female and male connectors 1A and 2A away from each other, and in order to achieve this, the resilient force of the compression springs 9 must be set to a value larger than the force with which the two connectors are connected together, with the housing lock 8 engaged in the engagement groove 24 in the mating connector. Therefore, if the strength of connection, achieved by the engagement of the housing lock 8 in the engagement groove 24, is increased, the resilient force of the spring members 9 becomes so large that a large force is required for fitting the two connectors together, and this has invited a problem that the connector-fitting operation can not be carried out easily.

SUMMARY OF THE INVENTION

It is therefore an object of the present invention to solve the above problems, and more specifically to provide a half-fitting prevention connector in which a half-fitted condition is positively prevented during the time when fitting a pair of connectors together, and also a force, required for fitting the two connectors together in the connector fitting operation, is reduced.

To achieve the above object, according to the first aspect of the present invention, there is provided a half-fitting prevention connector which comprises a pair of connectors fittable to each other, the connectors including housings, respectively, a spring member receivable in the housing of one of the connectors, a slider receivable in the housing of one of the connectors, a lock arm provided in the housing of one of the connectors, the lock arm having an engagement portion, wherein a half-fitted condition of the connectors is prevented by a resilient force of the spring member, and when the one of the connectors is to be fitted relative to the other one of the connectors, the slider cooperates with the spring member to move between a lock position where the slider causes the lock arm to be retainingly engaged with the housing of the other one of the connectors and a non-lock position, a completely-retaining portion retaining the engagement portion of the lock arm, the completely-retaining portion being formed on the housing of the other one of the connectors, and a provisionally-retaining portion retaining the engagement portion with a retaining force smaller than that of the completely-retaining portion, the provisionally-retaining portion being formed on the housing of the other one of the connectors, wherein the completely-retaining portion and the provisionally-retaining portion are juxtaposed to each other in a direction of a width of the housing of the other one of the connectors, and wherein, when the slider is moved to the lock position in a connector fitting operation, the slider deforms the lock arm in the direction of the width of the housing so as to displace the engagement portion of the lock arm from the provisionally-retaining portion to the completely-retaining portion.

In the above construction, at an initial stage of the connector fitting operation, the slider, mounted on the one connector, abuts against the other connector, and is pushed to the non-lock position against the bias of the spring member. If this pushing operation is stopped in this half-fitted condition, the two connectors are returned or moved away from each other (that is, in a disconnecting direction opposite to the fitting direction) by the resilient force of the spring member, and therefore such a half-fitted condition can be easily detected.

Then, when the amount of fitting of the two connectors relative to each other reaches a predetermined value, the engagement portion of the lock arm, formed on the one connector, engages the provisionally-retaining portion, and also the engagement of the slider with the other connector is canceled, so that the slider begins to be returned to the lock position near to the distal end of the lock arm under the influence of the spring member.

Then, when the two connectors are fitted together, so that the slider is returned to the lock position, the slider displaces the engagement portion of the lock arm to the completely-retaining portion, and therefore the engagement portion of the lock arm is retained by the completely-retaining portion, so that the two connectors are locked to each other.

If the two connectors are incompletely fitted together, so that the slider can not be returned to the lock position, the engagement portion of the lock arm is not displaced to the completely-retaining portion, but is kept engaged with the provisionally-retaining portion having the retaining force smaller than that of the completely-retaining projection. Therefore, the required force, produced by the spring member so as to move the two connectors away from each other through the slider to disconnect the two from each other, can be reduced as compared with the case where the engagement portion of the lock arm is retained by the completely-retaining portion.

Namely, the spring member for moving the two connectors away from each other through the slider can be designed to produce a small resilient force, and even in this case, when there develops an incompletely-fitted condition in which the slider can not be returned to the lock position, the two connectors, half fitted together, can be moved away from each other by the resilient force of the spring member to such an extent that they are disconnected from each other, and the incompletely-fitted condition of the two connectors is positively prevented.

Therefore, the resilient force of the spring member is kept to a small value, and by doing so, the force, required for fitting the two connectors together, can be reduced, and the operating for fitting the two connectors together can be carried out easily.

According to the second aspect of the present invention, preferably, the lock arm extends in such a manner that it is inclined in the direction of the width of the housing so that the engagement portion can advance onto the provisionally-retaining portion in the connector fitting operation, and the slider includes an arm correcting portion which corrects the inclination of the lock arm in the direction of the width of the housing when the slider is moved to the lock position, thereby displacing the engagement portion of the lock arm to the completely-retaining portion.

According to the third aspect of the present invention, preferably, the lock arm extends in such a manner that the engagement portion can advance onto the completely-retaining portion in the connector fitting operation, and the slider includes an arm pressing portion which presses a slanting side surface of the lock arm in the direction of the width of the housing when the slider is moved from the lock position to the non-lock position, thereby displacing the engagement portion of the lock arm to the provisionally-retaining portion.

According to the fourth aspect of the present invention, preferably, the half-fitting prevention connector further comprises a guide step portion which guides the engagement portion of the lock arm to the provisionally-retaining portion in the connector fitting operation, the guide step portion is formed at that side of the completely-retaining portion close to a front side of the other connector.

DETAILED DESCRIPTION OF THE PREFERRED EMBODIMENT

One preferred embodiment of a half-fitting prevention connector of the present invention will now be described in detail with reference to FIGS. 1 to 12.

Figure 1:
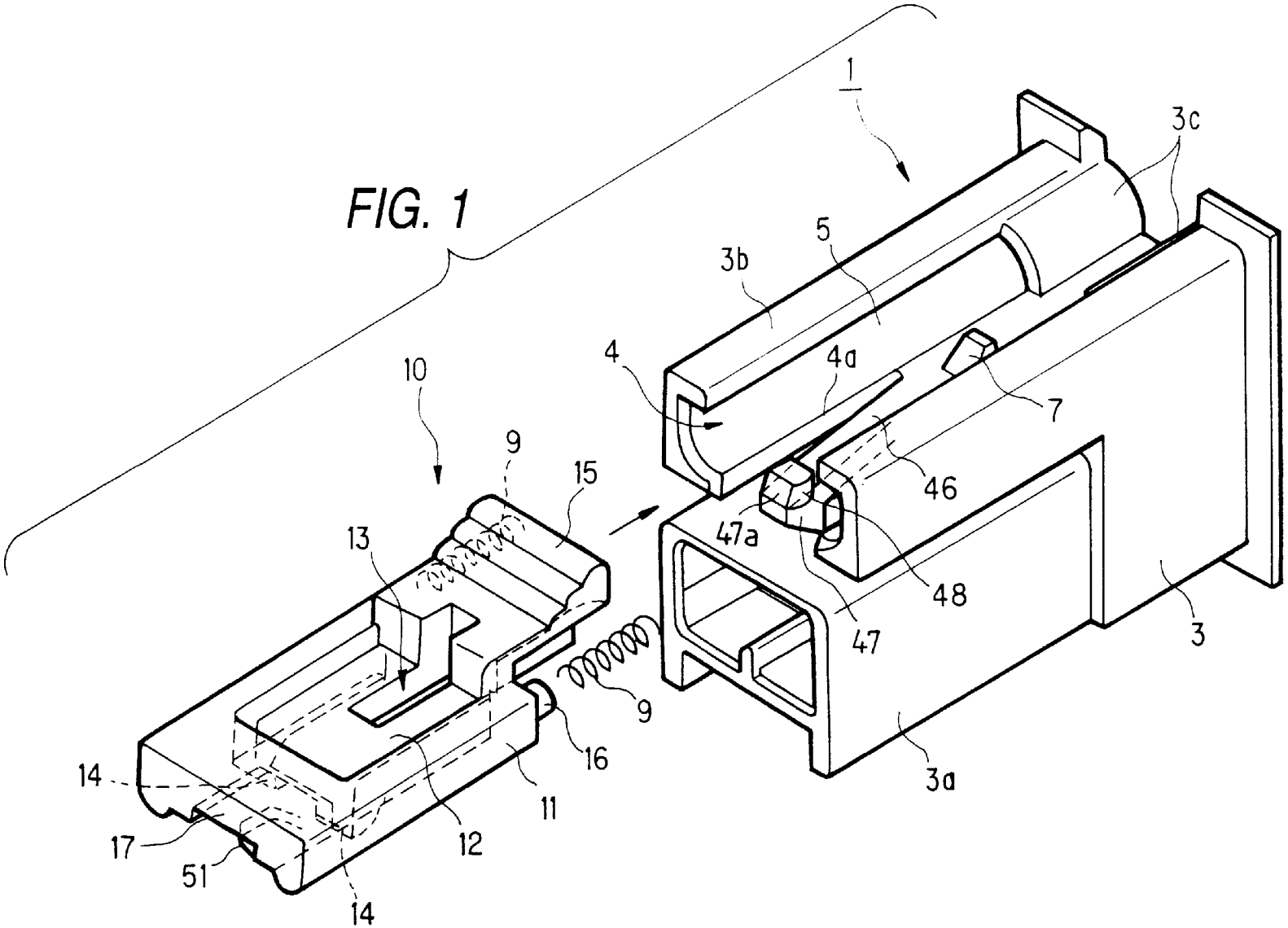
FIG. 1 is an exploded, perspective view showing a female connector in one preferred embodiment of a half-fitting prevention connector of the present invention.
Figure 3:
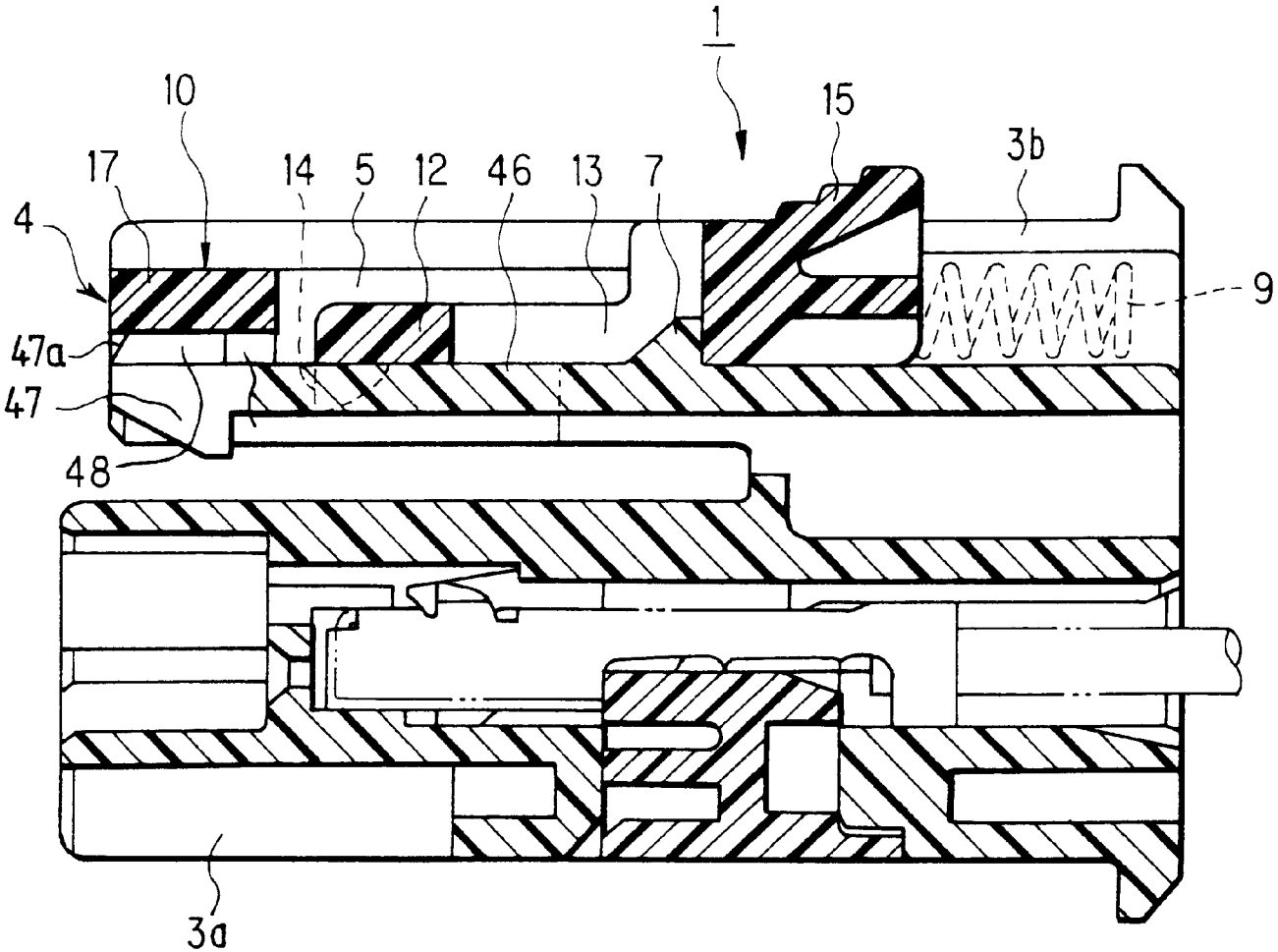
FIG. 3 is a vertical cross-sectional view of the connector of FIG. 1 having the slider mounted thereon.

As shown in FIGS. 1 and 3, a female connector 1 (one of a pair of female and male connectors 1 and 2 constituting the half-fitting prevention connector of this embodiment) comprises a housing 3, and this housing 3 includes a connector housing 3*a*, having terminal receiving chambers, and a slider housing 3*b* which is provided above the connector housing 3*a*, and has a slider receiving portion 4 for slidably receiving a slider 10 (described later). Guide grooves 5 for respectively guiding opposite side portions of a slider body 11 are formed respectively in opposite side portions of the slider housing 3*b*. A spring receiving portion 3*c* of a tubular shape is formed at a rear end of each of the guide grooves 5.

An elastic lock arm 46 of the cantilever type is formed integrally with the slider housing 3*b* at a widthwise central portion thereof, and extends in a fitting direction, and a distal end portion (free end portion) of this lock arm is elastically displaceable in an upward-downward direction. A lock beak 7, having a slanting surface, is formed on an upper surface of the lock arm 46, and a housing lock (engagement portion) 47 for retaining engagement with the male connector (not shown) is formed on a lower surface of the lock arm 46 at the distal end thereof. A displacement prevention projection 47a for preventing the displacement of the lock arm 46 is formed on the upper surface of the lock arm 46, and faces away from the housing lock 47. Side spaces 4*a* for respectively receiving abutment projections 14 of the slider 10 (described later) are formed at opposite sides of the lock arm 46, respectively.

The slider 10 includes an elastic slider arm 12 provided within the slider body 11 at a generally central portion thereof, and this slider arm 12 has the pair of abutment projections 14 and 14 formed respectively at opposite side portions of a lower surface thereof at a front end portion thereof. The slider also includes a pressing portion 15, which is formed on an upper surface thereof at a rear end thereof, and is operated when canceling the fitting connection, and a slide groove 13 formed in the slider arm 12 and the pressing portion 15. Spring retaining portions 16 for respectively retaining compression springs (spring members) 9 are formed respectively at opposite side portions of a lower portion of the slider body 11 at the rear end thereof. A displacement prevention portion 17 for preventing the displacement of the lock arm 46 is formed at the front end of the slider body 11.

When the slider 10, having the compression springs 9 held respectively on the spring retaining portions 16, is pushed into the slider receiving portion 4 of the female connector 1 from the front side thereof as shown in FIG. 1, the slider body 11 moves along the guide grooves 5 toward the rear end of the female connector. At this time, the abutment projections 14, formed at the lower surface of the slider arm 12, are received respectively in the side spaces 4*a* formed respectively at the opposite sides of the lock arm 46. Then, the compression springs 9 are received in the spring receiving portions 3*c*, respectively, and the lock beak 7 is fitted in the slide groove 13, so that the slider 10 is held on the housing 3 for movement between a lock position and a non-lock position.

In the non-lock position (which is near to the proximal end of the lock arm 46) of the slider 10, the slider 10 allows the lock arm 46 to be elastically deformed when the lock arm 46 is brought out of engagement with the mating housing. In the lock position (which is near to the distal end of the lock arm) of the slider 10, the displacement prevention portion 17 is held against the displacement prevention projection 47*a* of the lock arm 46, thereby preventing the elastic deformation of the lock arm 46.

Figure 2:
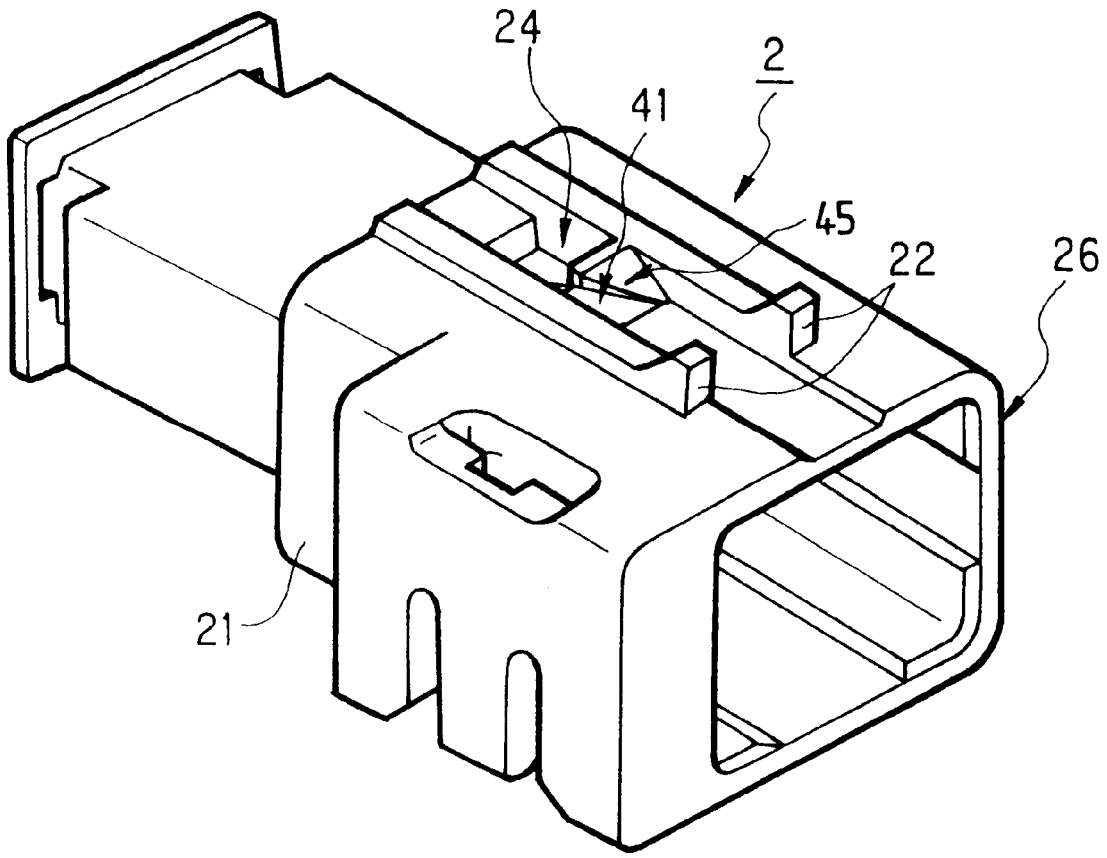
FIG. 2 is a perspective view of a male connector in the half-fitting prevention connector of the above embodiment.
Figure 4:
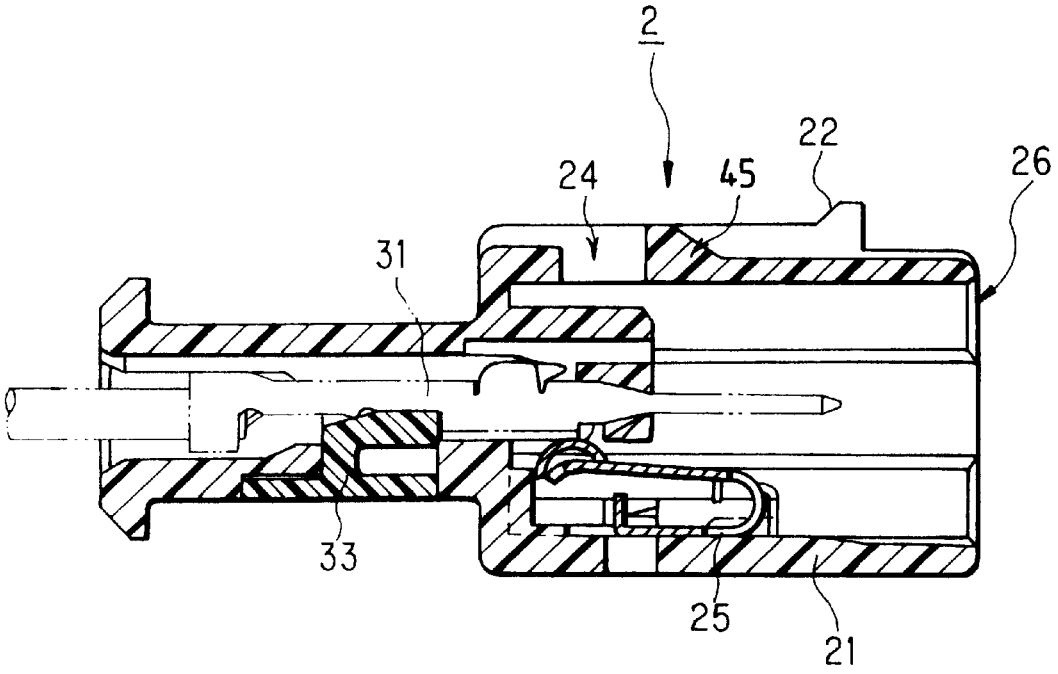
FIG. 4 is a vertical cross-sectional view of the male connector of FIG. 2.

As shown in FIGS. 2 and 4, the male connector 2 includes a pair of stopper projections 22 and 22, which are formed on a surface of a housing 21 so as to abut respectively against the abutment projections 14 of the slider 10 during the connector-fitting operation, the housing 21 having terminal receiving chambers.

Figure 6:
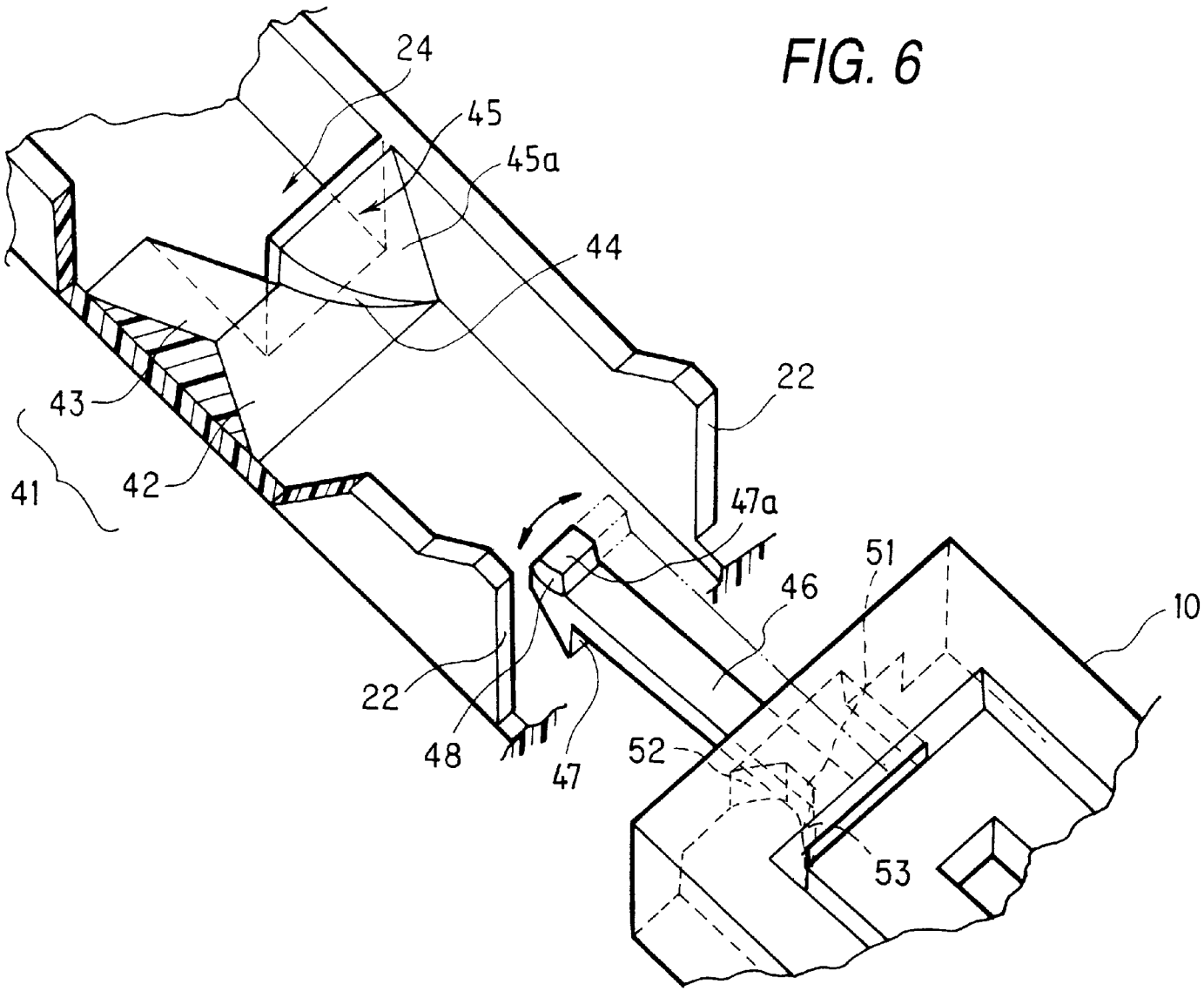
FIG. 6 is an enlarged perspective view of important portions of the female and male connectors of FIG. 5.

As best shown in FIG. 6, a provisionally-retaining projection (provisionally-retaining portion) 41 and a completely-retaining projection (completely-retaining portion) 45 are formed on the upper surface of the housing 21 of the male connector 2, and are juxtaposed to each other in a direction of the width of the housing 21, the two retaining projections 41 and 45 being disposed between the pair of stopper projections 22 and 22. The provisionally-retaining projection 41 retains the housing lock 47 of the lock arm 46 when the amount of fitting of the female and male connectors 1 and 2 relative to each other reaches a predetermined value.

At an initial stage of the fitting of the female and male connectors 1 and 2, the pair of stopper projections 22 and 22 abut against the slider 10 to push the slider 10 back toward the non-lock position against the bias of the compression springs 9 until the engagement of the housing lock 47 with the provisionally-retaining projection 41 is completed, and after the engagement of the housing lock 47 with the provisionally-retaining projection 41 is completed, the abutting engagement of the stopper projections 22 and 22 with the slider 10 is canceled.

The provisionally-retaining projection 41 includes a slanting surface 42, which is provided at that portion thereof close to the front side of the connector, is slanting upwardly in the direction of advancing of the lock arm 46, and a downwardly-slanting surface 43 which extends from a rear end of the slanting surface 42. The slanting surface 42, provided at that portion of the projection 41 close to the front side of the connector, elastically deforms the advancing lock arm 46 upwardly, and the slanting surface 43 retains the housing lock 47 of the lock arm 46 slid over the slanting surface 42.

The completely-retaining projection 45 includes an upwardly-slanting surface 45*a* which is provided at that portion thereof close to the front side of the connector, and elastically deforms the advancing lock arm 46 upwardly. An engagement groove 24, provided at the rear side of the completely-retaining projection 45, retains the housing lock 47 of the lock arm 46 slid over the completely-retaining projection 45.

Namely, the rear end surfaces of the provisionally-retaining and completely-retaining projections 41 and 45 for retaining the housing lock 47 are different in inclination from each other, and with this construction the force of retaining of the housing lock 47 by the provisionally-retaining projection 41 is smaller than the force of retaining of the housing lock 47 by the completely-retaining projection 45.

In this embodiment, a guide step portion 44 for guiding the housing lock 47 of the lock arm 46 to the provisionally-retaining projection 41 is formed at the boundary between the slanting surface 45*a* of the completely-retaining projection (provided at that portion thereof close to the front side of the connector) and the slanting surface 42.

The completely-retaining projection 45 and the provisionally-retaining projection 41 of the male connector 2 are juxtaposed to each other in the direction of the width of the housing as described above, and besides the lock arm 46 of the female connector 1 extends in such a manner that it is inclined left in the direction of the width of the housing so that the housing lock 47 can advance onto the provisionally-retaining projection 41 when the female and male connectors 1 and 2 are to be fitted together.

An arm correcting force-acting portion 48, defined by a curved surface, is formed in a bulged manner on a left side surface of the displacement prevention projection 47*a* formed on the upper surface of the lock arm 46 at the distal end thereof.

An arm correcting portion 51 is provided at a portion of the lower surface of the displacement prevention portion 17 of the slider 10. When the slider 10 is moved to the lock position, this arm correcting portion 51 is brought into engagement with the correcting force-acting portion 48 of the lock arm 46 to push or move the distal end portion of the lock arm 46 toward the completely-retaining projection 45 to correct the inclination of the lock arm 46 in the direction of the width of the housing, thereby displacing the housing lock 47 into the engagement groove 24.

Sliding contact surfaces 52 and 53, which are smoothly slanting or curved, are formed respectively on front and rear surfaces of the arm correcting portion 51 (which are spaced from each other in the fitting direction), and these sliding contact surfaces 52 and 53 can produce a pressing force to press the distal end portion of the lock arm 46 toward the central portion of the housing in the direction of the width thereof.

Figure 10:
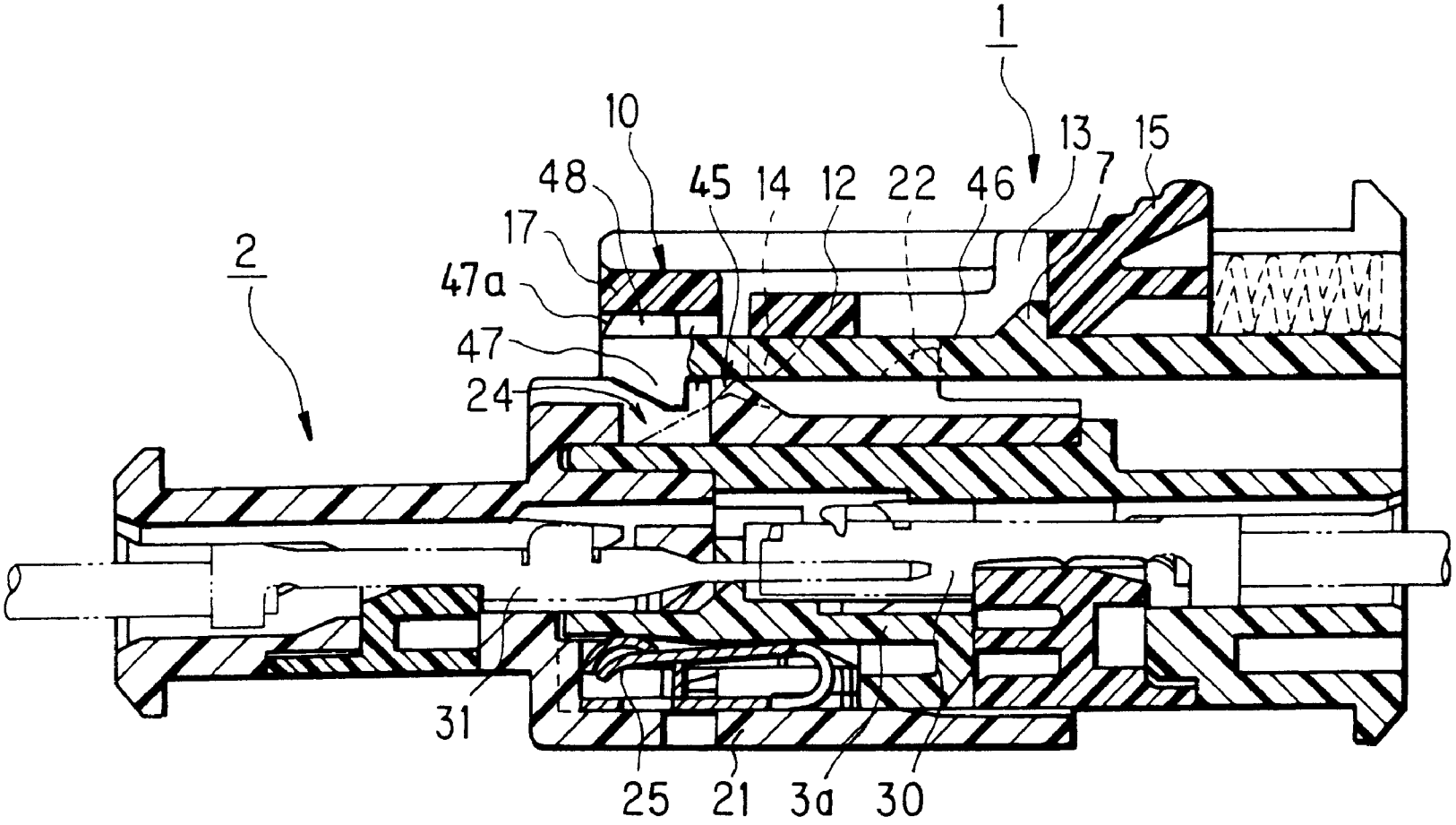
FIG. 10 is an enlarged, plan view of the important portions, showing the positions of the lock arm, the completely-retaining portion and the slider relative to each other immediately before the female and male connectors of FIG. 8 are completely fitted together.
Figure 11:
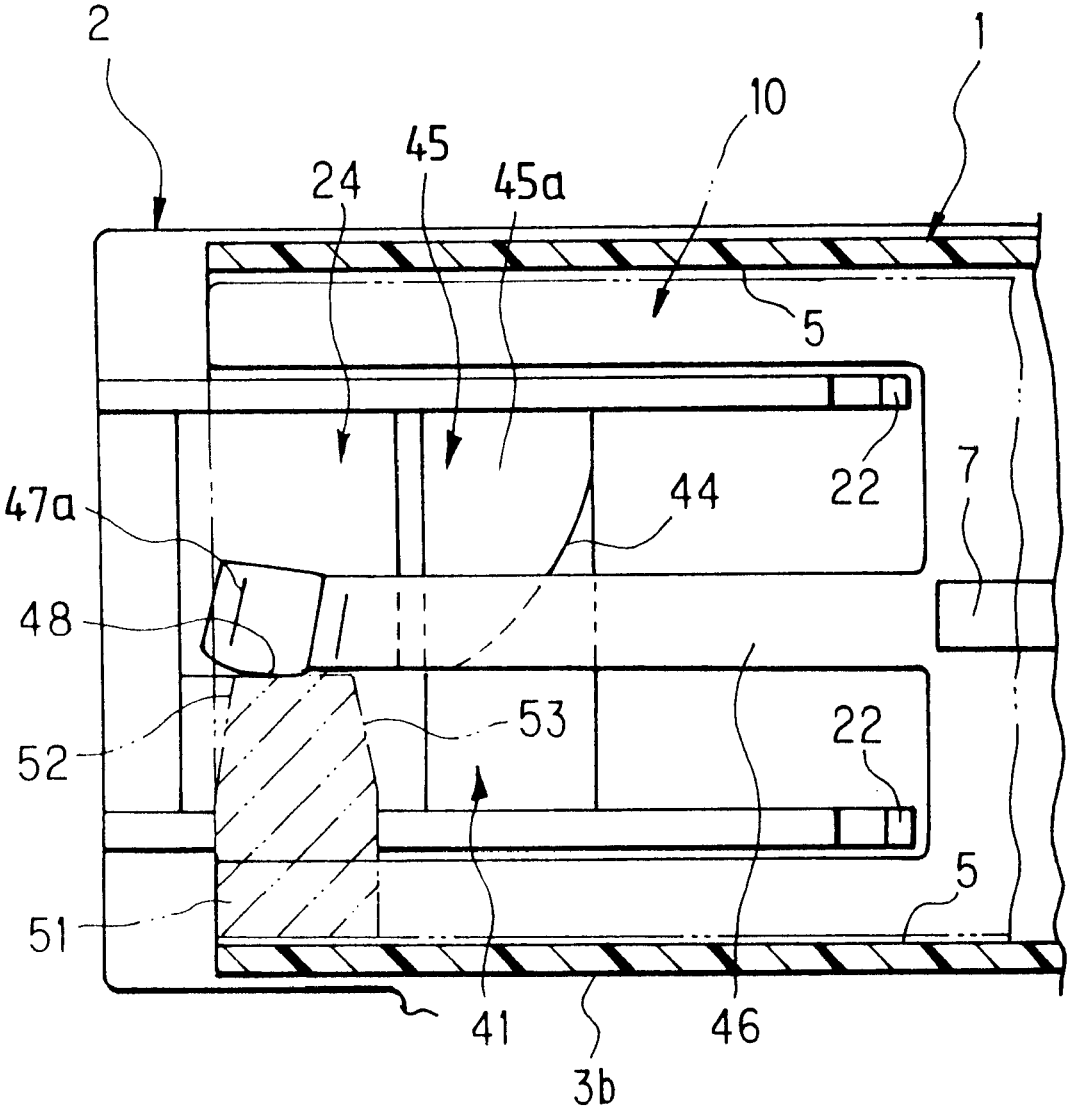
FIG. 11 is an enlarged, plan view of the important portions, showing the positions of the lock arm, the completely-retaining portion and the slider relative to each other in the female and male connectors of FIG. 10.

As shown in FIGS. 10 and 11, the sliding contact surface 52 displaces the distal end portion of the lock arm 46 when the slider 10, mounted on the female connector 1, is returned to the lock position. The sliding contact surface 53 displaces the distal end portion of the lock arm 46 when the slider 10 is mounted in the slider receiving portion 4 of the female connector 1.

Next, the operation for fitting the female and male connectors 1 and 2 together will be described.

Figure 5:
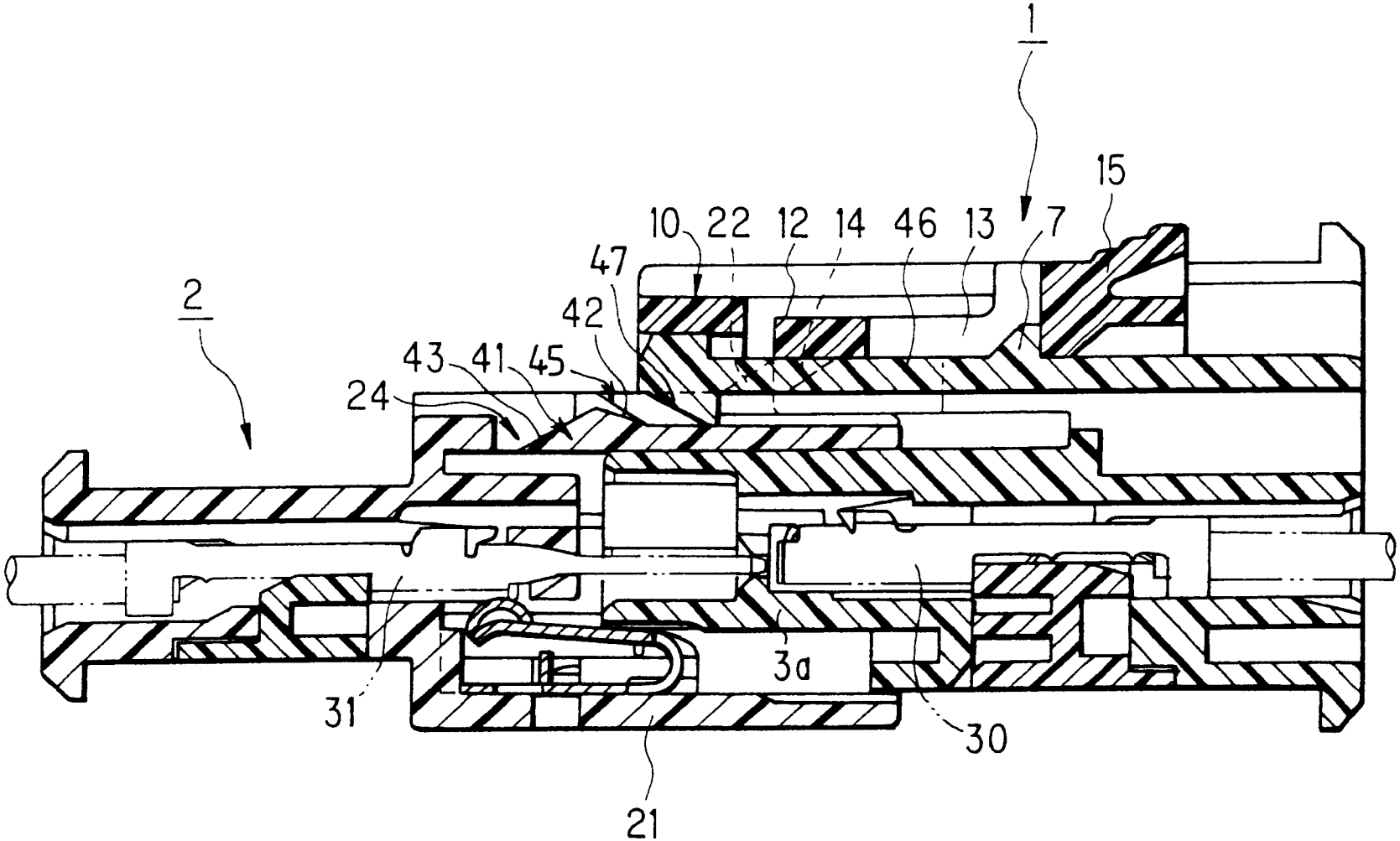
FIG. 5 is a vertical cross-sectional view of the female and male connectors of the above embodiment at an initial stage of fitting of these connectors.

As shown in FIGS. 5 and 6, when the operation for fitting the female and male connectors 1 and 2 together is started, the stopper projections 22 of the male connector 2 are inserted respectively into the side spaces 4*a* (see FIG. 1), formed respectively at the opposite sides of the lock arm 46 of the female connector 2, and abut respectively against the abutment projections 14. From this time on, the resilient force of the compression springs 9 is produced. At this stage, pin contacts 31, mounted in the male connector 2, are not yet fitted respectively in socket contacts 30 mounted in the female connector 1.

Then, when the fitting operation further proceeds, the slider 10 is pushed rearward (right in FIG. 5) against the bias of the compression springs 9, so that the housing lock 47, formed at the distal end of the lock arm 46, abuts against the slanting surface 42 formed at that portion of the provisionally-retaining projection 41 close to the front side of the connector.

Figure 7:
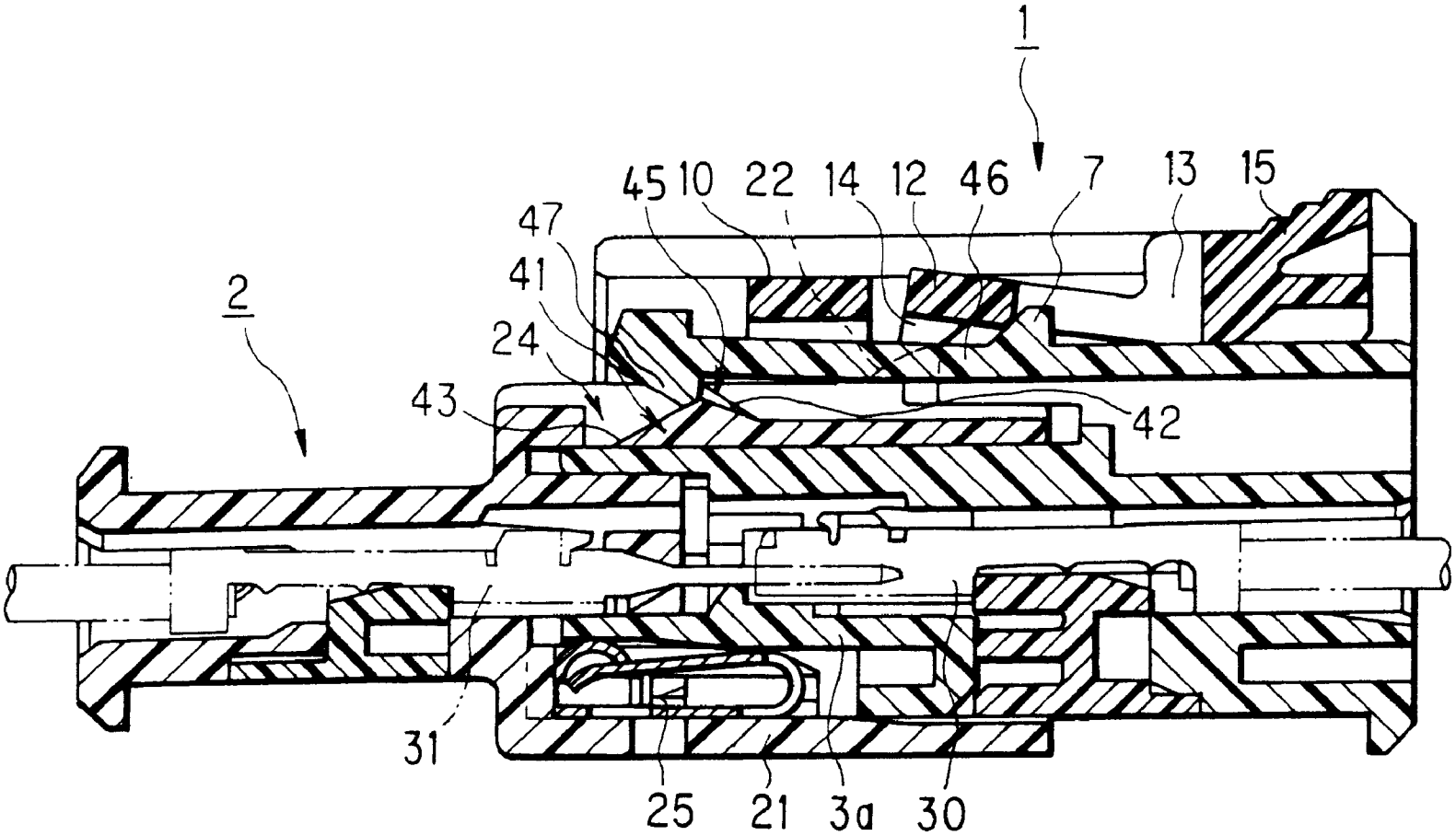
FIG. 7 is a vertical cross-sectional view showing a condition in which the female and male connectors of FIG. 5 are half fitted together.
Figure 8:
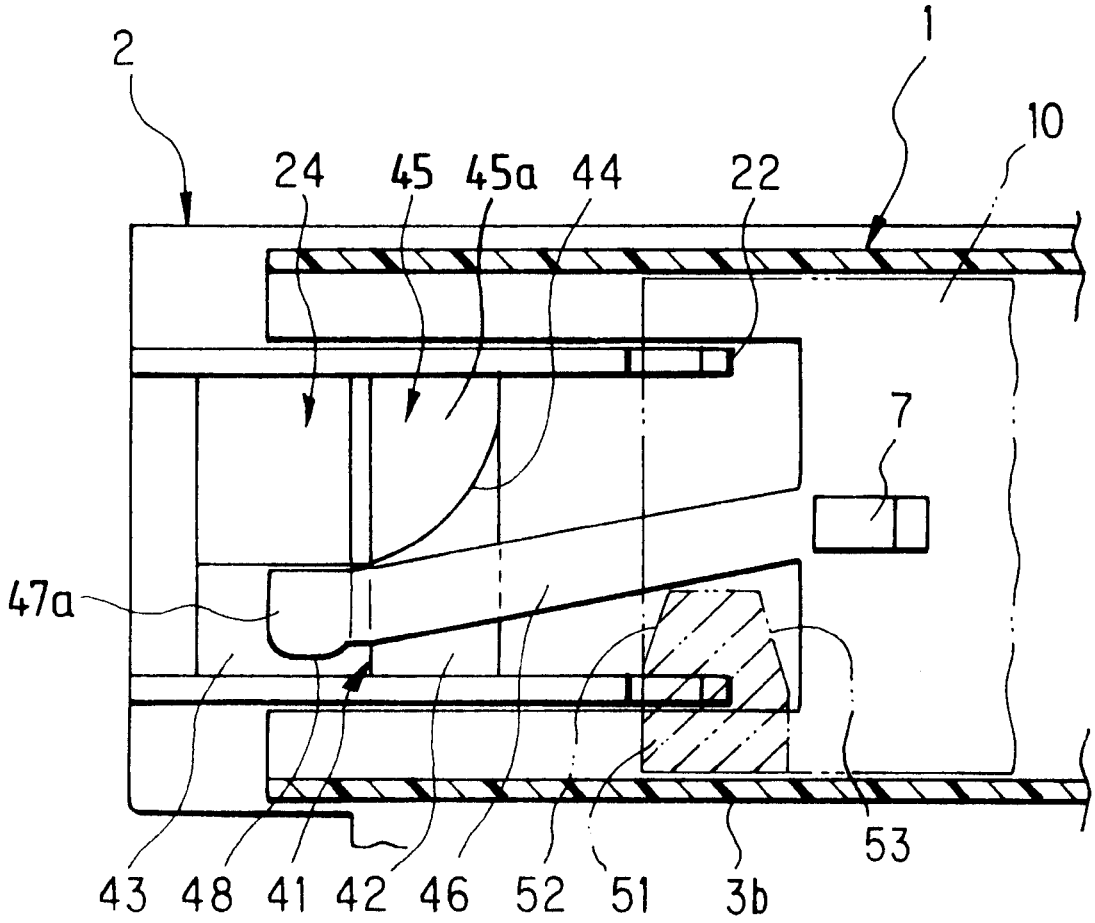
FIG. 8 is an enlarged, plan view of important portions, showing the positions of a lock arm of the female connector, a completely-retaining portion of the male connector and the slider relative to each other.

Then, the fitting operation further proceeds, and when the fitting amount reaches a predetermined value, the housing lock 47 at the distal end of the lock arm 46 slides over the slanting surface 42, and engages the slanting surface 43 of the provisionally-retaining projection 41 as shown in FIGS. 7 and 8, and at the same time the slider arm 12 of the slider 10 is elastically deformed upwardly by the lock beak 7, so that the engagement of the stopper projections 22 with the abutment projections 14 of the slider 10 is canceled.

The slider 10, thus disengaged from the stopper projections 22, begins to be returned to the lock position by the resilient force of the compression springs 9.

If the fitting operation is stopped in a half-fitted condition, in which the engagement of the slider 10 with the stopper projections 22 is not canceled, though the fitting amount reaches the predetermined amount, the female and male connectors 1 and 2 are returned or moved away from each other (that is, in a disconnecting direction opposite to the fitting direction) by the resilient force of the compression springs 9, and therefore such a half-fitted condition can be easily detected. At this time, the housing lock 47 of the lock arm 46 is engaged with the slanting surface 43 of the provisionally-retaining projection 41, and therefore when the female and male connectors 1 and 2 are urged away from each other, the housing lock 47 can easily slide over the slanting surface 43 to be disengaged from the provisionally-retaining projection 41.

Figure 9:
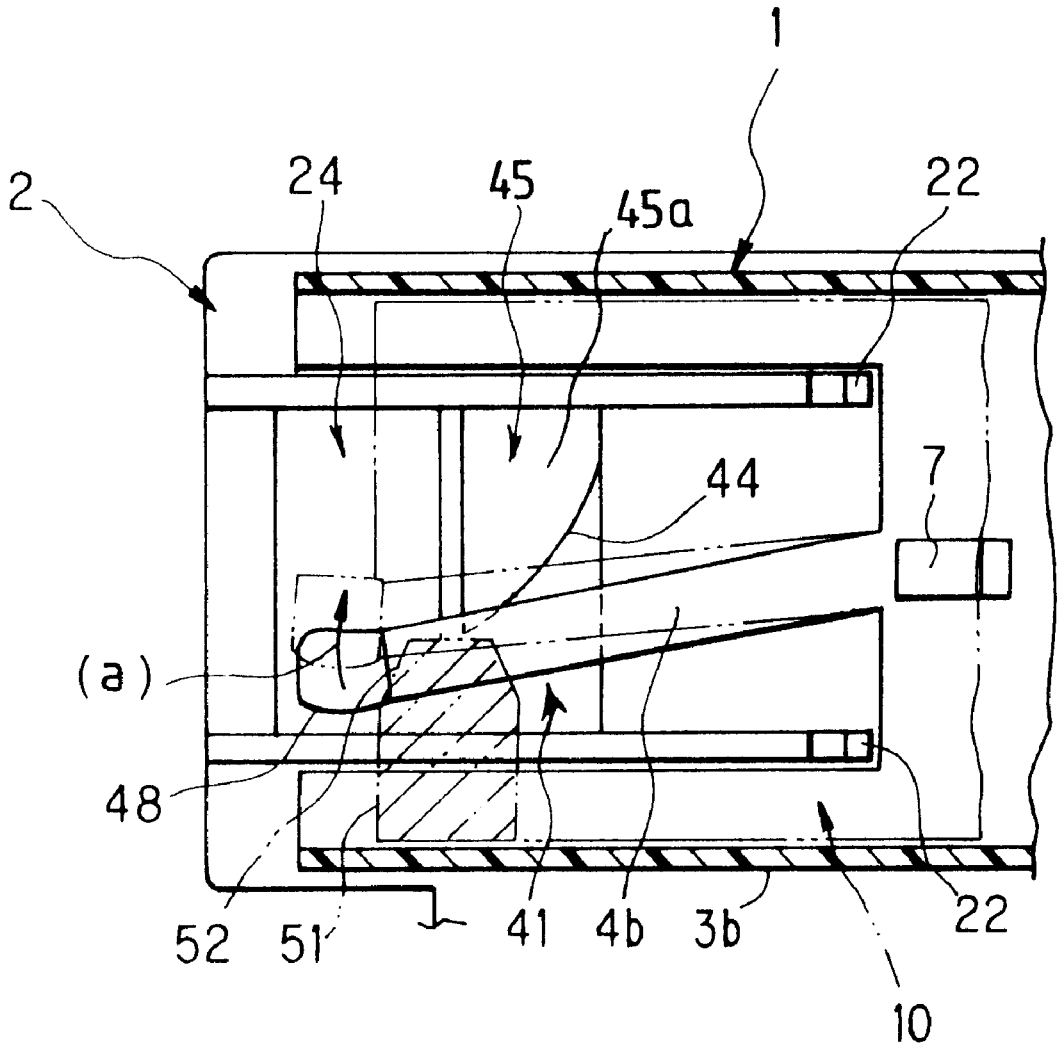
FIG. 9 is a vertical cross-sectional view showing a condition in which the female and male connectors of FIG. 5 are completely fitted together.

Then, when the slider 10 approaches the lock position as shown in FIG. 9, the sliding contact surface 52, formed on the front end of the arm correcting portion 51 of the slider 10, abuts against the correcting force-acting portion 48 of the lock arm 46 to push the distal end portion of the lock arm 46 toward the central portion of the housing in the direction of the width thereof as indicated by arrow (a), thereby correcting the inclination of the lock arm 46 in the direction of the width of the housing. As shown in FIG. 11, when the slider 10 is completely returned to the lock position, the free end portion of the lock arm 46 is displaced to the completely-retaining projection 45 having the larger retaining force than the provisionally-retaining projection 41 has, and therefore the housing lock 47 of the lock arm 46 is retained in the engagement groove 24, so that the female and male connectors 1 and 2 are locked to each other.

At this time, the displacement prevention portion 17 of the slider 10 abuts against the upper surface of the displacement prevention projection 47*a* of the lock arm 46 to prevent the upward elastic deformation of the lock arm 46, and therefore the cancellation of the completely-retaining engagement of the lock arm 46 with the completely-retaining projection 45 is prevented by the slider 10, thus achieving a double-locked condition.

In this condition in which the cancellation of the retaining engagement of the lock arm 46 is prevented by the slider 10, as shown in FIG. 10, the female and male connectors 1 and 2 are completely fitted together, and the contacts 30 are completely connected to the contacts 31, respectively.

This completely-fitted condition can be easily confirmed by viewing the position of the returned slider 10.

In the female and male connectors 1 and 2 of this embodiment, when the slider 10 is returned to the lock position. The housing lock 47 of the lock arm 46 is displaced from the provisionally-retaining projection 41 to the completely-retaining projection 45, thereby switching the retained condition. Therefore, in a half-fitted condition in which the slider 10 can not be returned to the lock position, the housing lock 47 of the lock arm 46 is kept engaged with the provisionally-retaining projection 41 having the smaller retaining force than the completely-retaining projection 45 has, and therefore the force, required for moving the female and male connectors 1 and 2, half fitted together, away from each other to disconnect the two from each other, can be reduced.

Therefore, the compression springs 9 for moving the two connectors away from each other through the slider 10 can be designed to produce a smaller resilient force than the compression springs in the construction of the related art, and even in this case, when there develops an incompletely-fitted condition in which the slider 10 can not be returned to the lock position, the female and male connectors 1 and 2, half fitted together, can be moved away from each other by the resilient force of the compression springs 9 to such an extent that they are electrically disconnected from each other, and the incompletely-fitted condition of the female and male connectors 1 and 2 is positively prevented from being overlooked.

The resilient force of the compression springs 9 is kept to a small value, and by doing so, the force, required for fitting the female and male connectors 1 and 2 together, can be reduced, and the operating for fitting the two connectors together can be carried out easily.

In this embodiment, the guide step portion 44 for guiding the housing lock 47 of the lock arm 46 to the provisionally-retaining projection 41 during the connector fitting operation is provided at the front side of the completely-retaining projection 45 provided in juxtaposed relation to the provisionally-retaining projection 41. Therefore, the housing lock 47 of the lock arm 46 is positively prevented from improperly advancing onto the completely-retaining projection 45 at an initial stage of the fitting operation, for example, because of an error in the molding of the two connectors. The provision of the guide step portion 44 can be omitted depending on the molding precision of the two connectors.

The half-fitting prevention connector of the present invention is not limited to the above embodiment, and various constructions can be adopted within the scope of the present invention.

Figure 12:
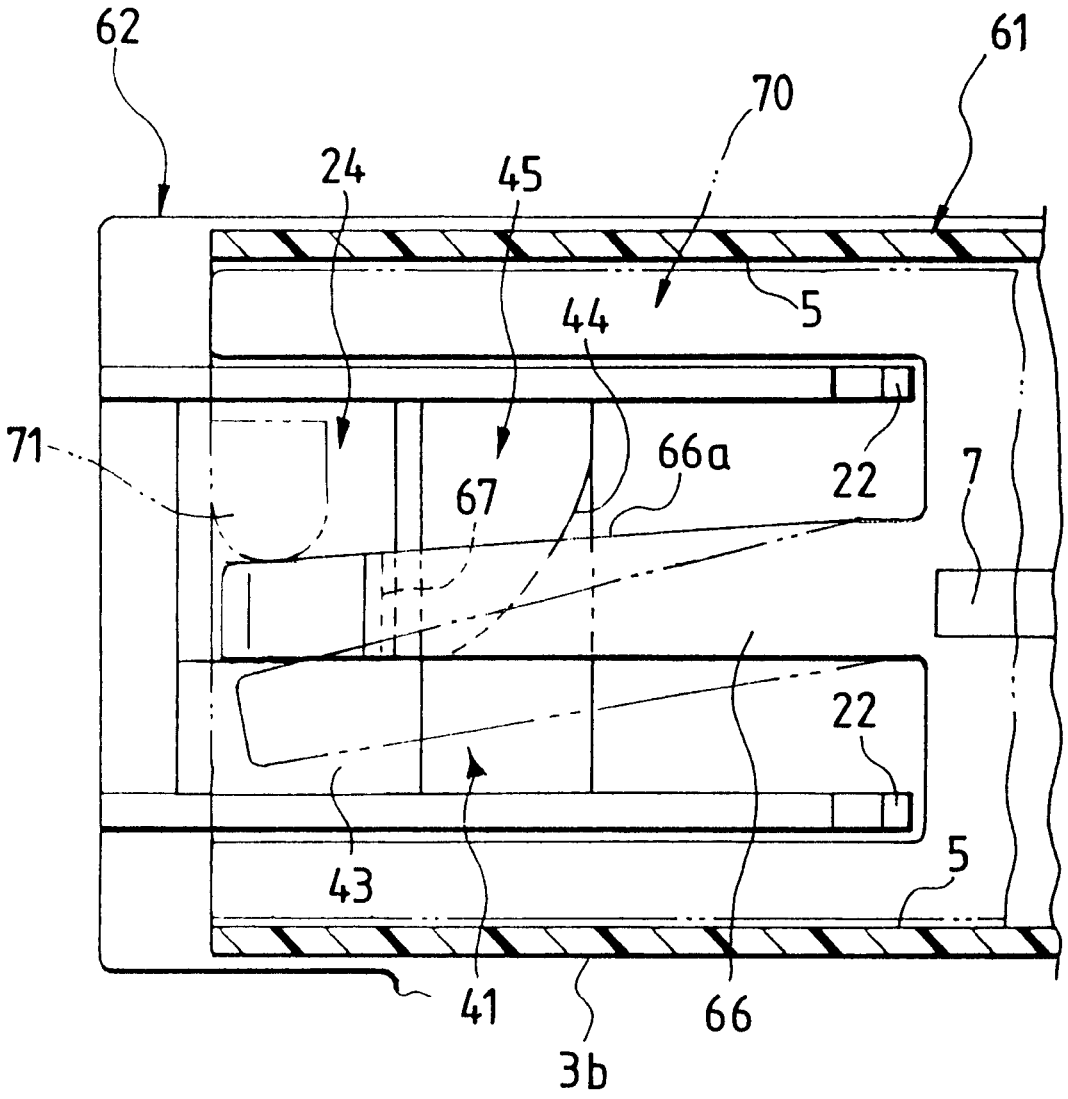
FIG. 12 is an enlarged, plan view of important portions of another embodiment of a half-fitting prevention connector of the present invention, showing the positions of a lock arm of a female connector, a completely-retaining portion of a male connector and a slider relative to each other.
Figure 13:
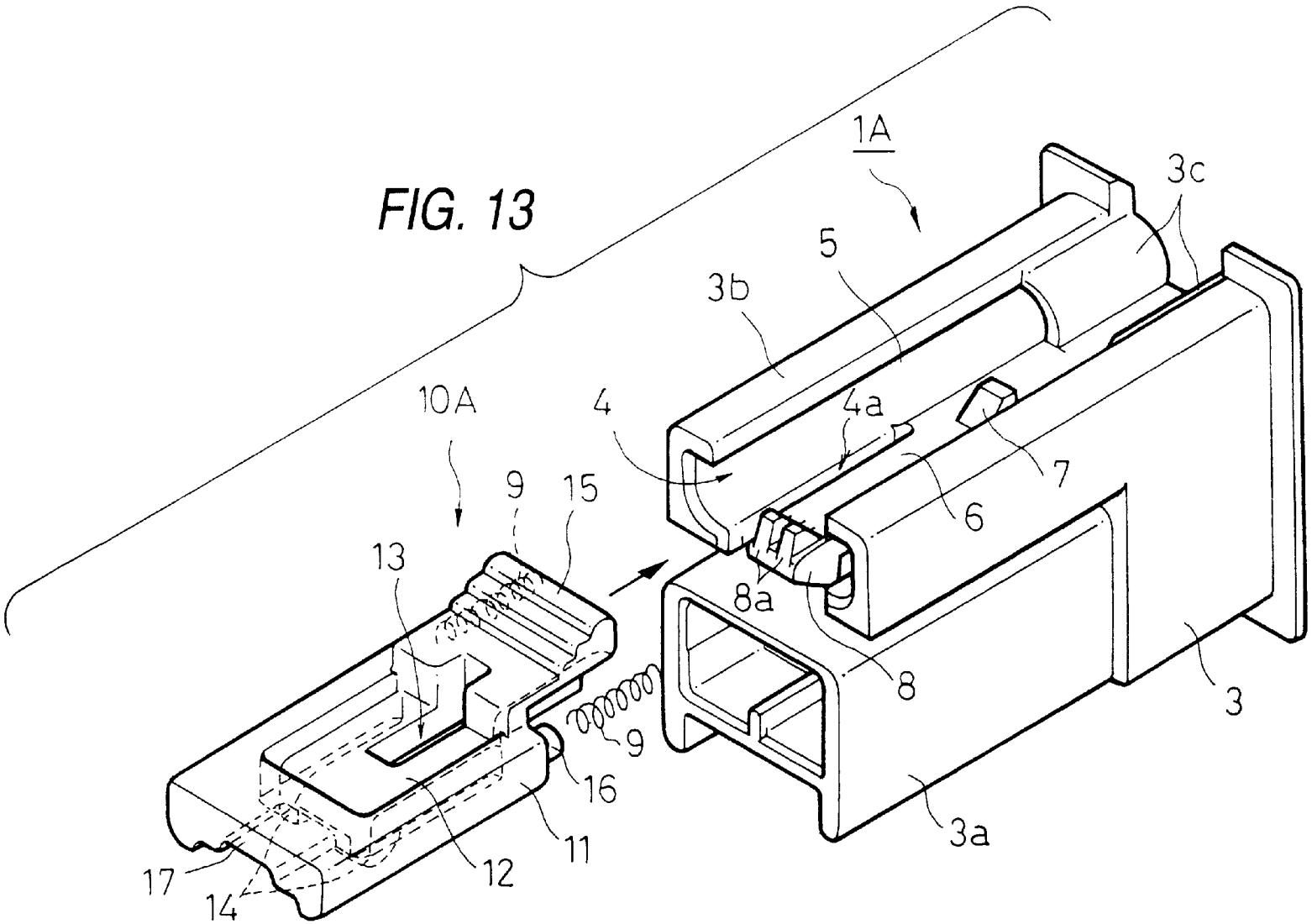
FIG. 13 is an exploded, perspective view of a female connector of a related half-fitting prevention connector.
Figure 14:
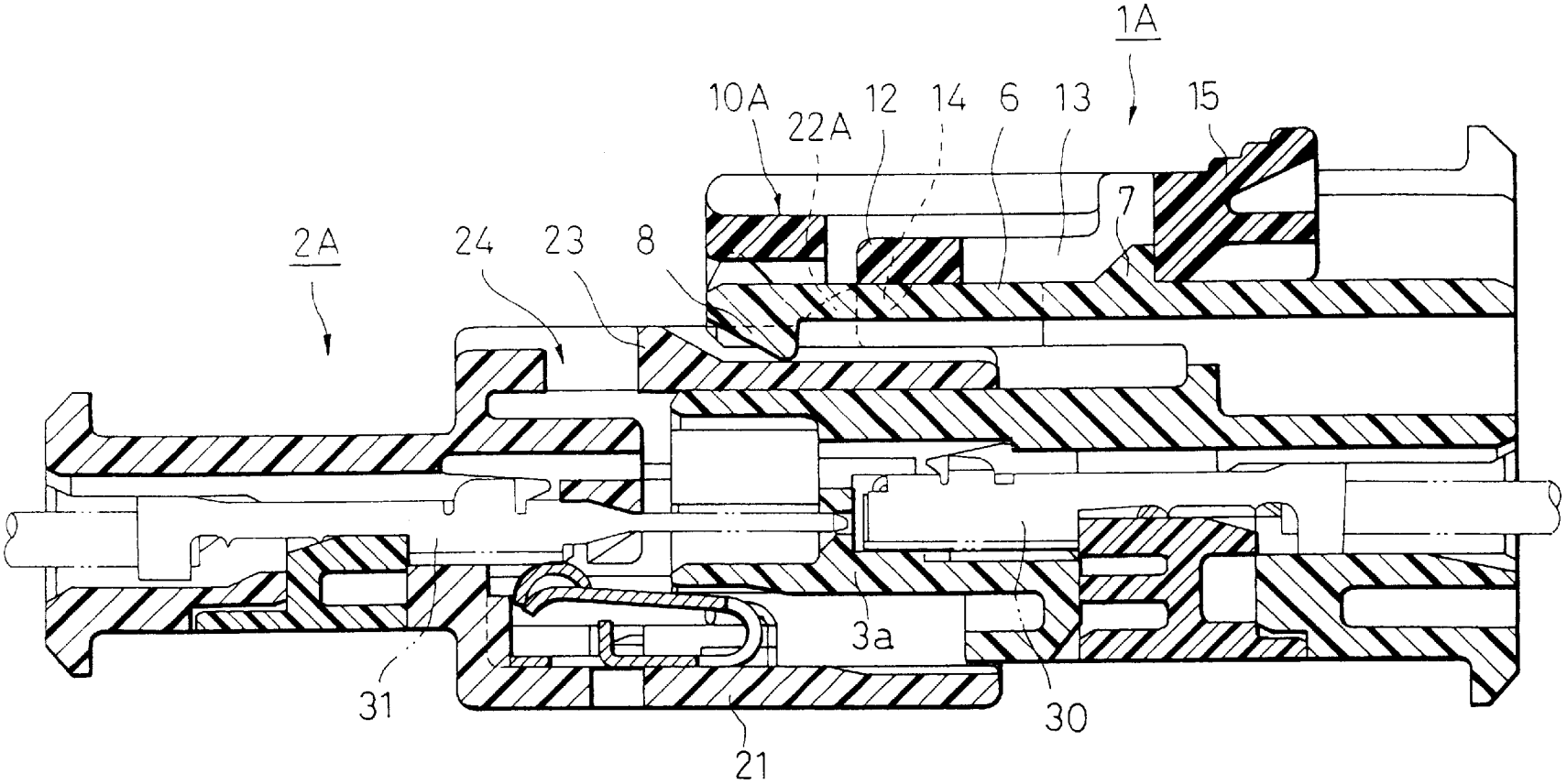
FIG. 14 is a view explanatory of an operation, showing an initial stage of fitting of the related female and male connectors.
Figure 15:
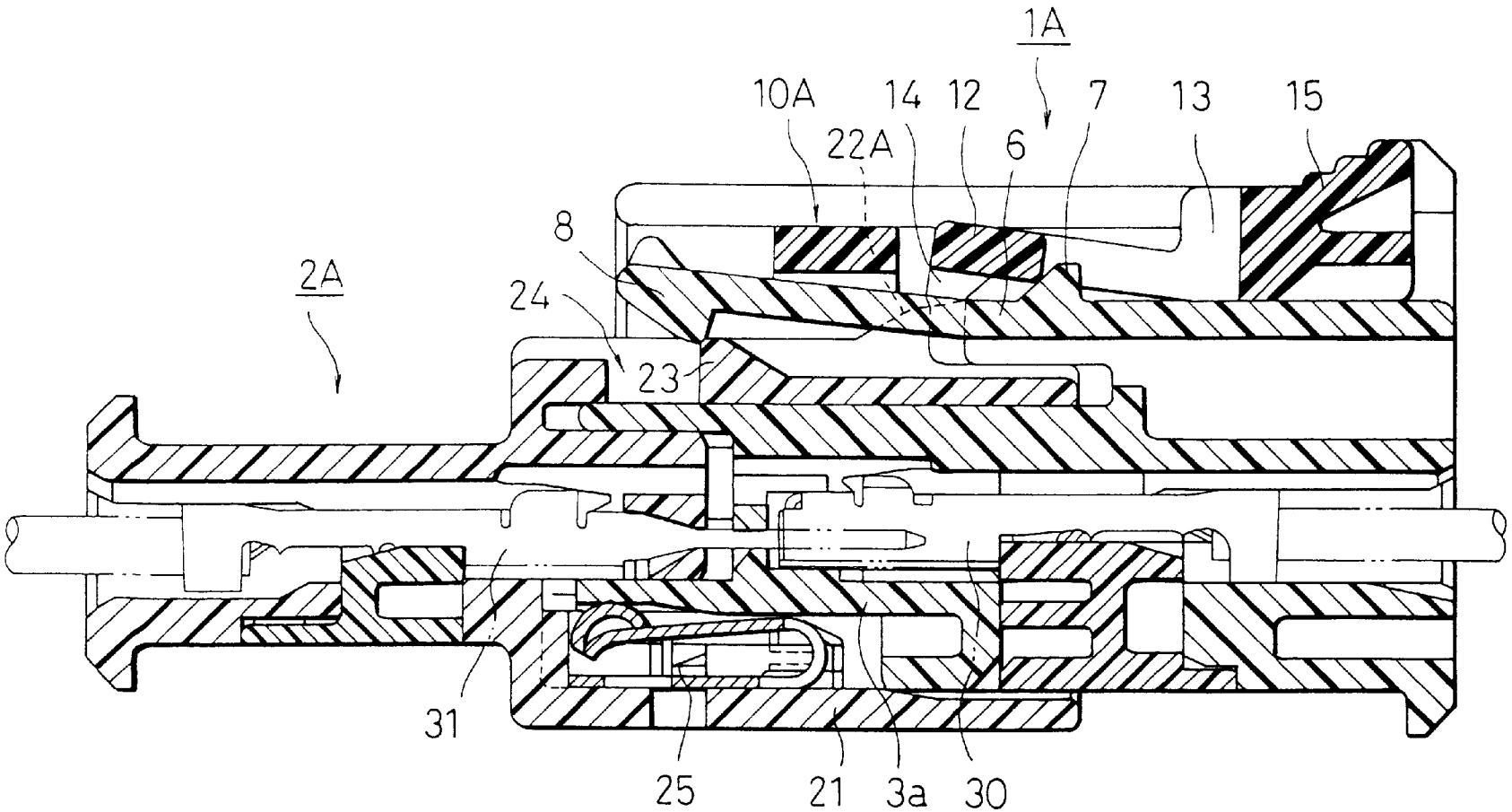
FIG. 15 is view explanatory of the operation, showing a condition in which the female and male connectors of FIG. 14 are half fitted together.
Figure 16:
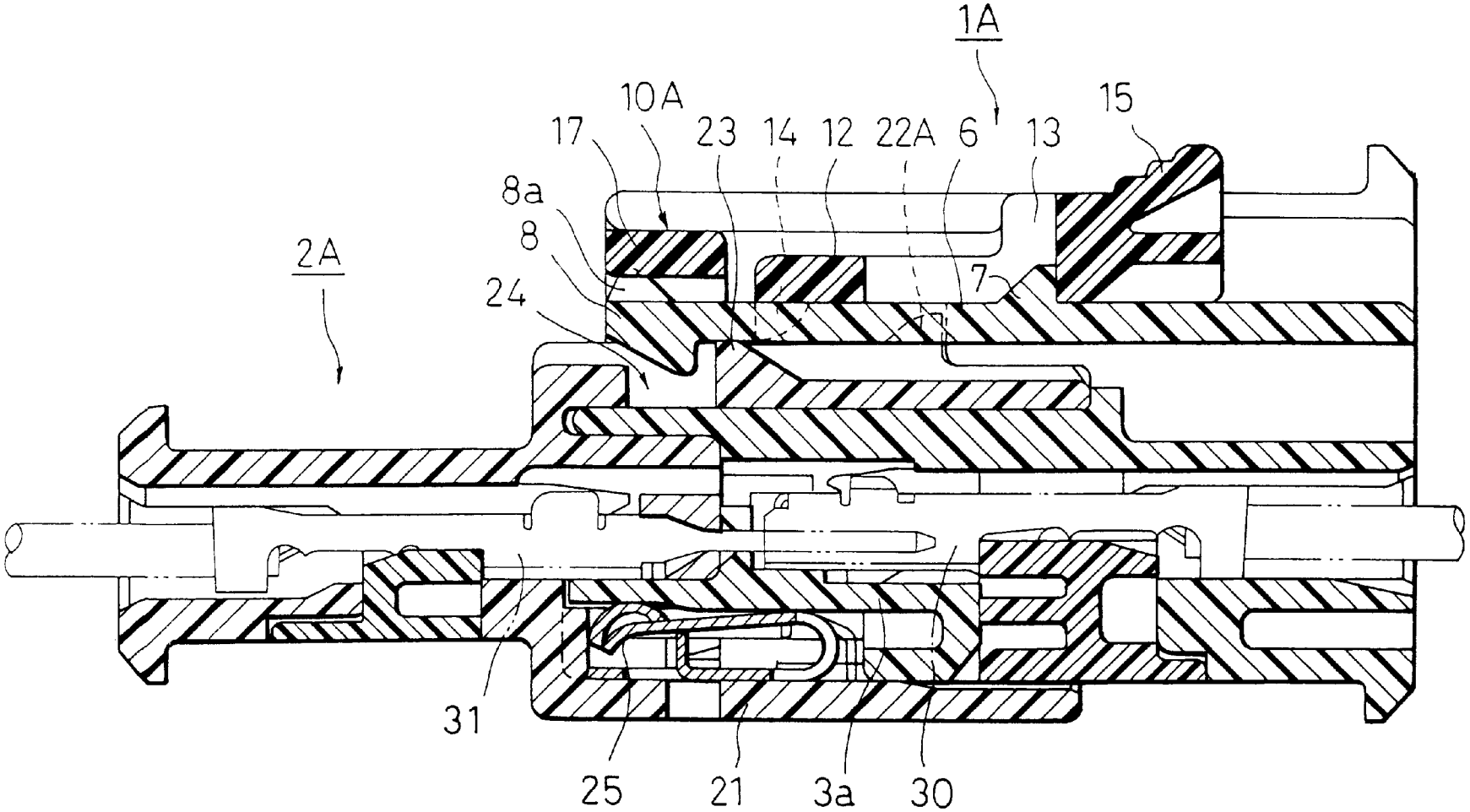
FIG. 16 is a view explanatory of the operation, showing a condition in which the female and male connectors of FIG. 14 are completely fitted together.

For example, in female and male connectors 61 and 62 shown in FIG. 12, a lock arm 66 of the female connector 61 extends in such a manner that a housing lock 67 can advance to the completely-retaining projection 45 when the two connectors are fitted together.

A slider 70 has an arm pressing portion 71, and when the slider is moved from the lock position (shown in FIG. 12) to the non-locked position, the arm pressing portion 71 presses a slanting side surface 66*a* of the lock arm 66 in the direction of the width of the housing (i.e., downward in FIG. 12), thereby displacing the housing lock 67 of the lock arm 66 to the provisionally-retaining projection 41.

When the operation for fitting the female and male connectors 61 and 62 together is started, the slider 70 is pushed toward the non-lock position, and at the same time the slanting side surface 66*a* of the lock arm 66 is pressed by the arm pressing portion 71 of the slider 70, so that the lock arm 66 is elastically deformed in the direction of the width of the housing (i.e., downward in FIG. 12). When the fitting amount reaches a predetermined amount, the housing lock 67 engages the slanting surface 43 of the provisionally-retaining projection 41.

Then, when the female and male connectors 61 and 62 are further fitted together, the slider 70, disengaged from the stopper projections 22, begins to be returned to the lock position under the influence of the compression springs 9.

When the slider 70 reaches the lock position, the pressing force, applied from the arm pressing portion 71 of the slider 70 to the slanting side surface 66*a* of the lock arm 66 to urge the same in the direction of the width of the housing, is released, and therefore the housing lock 67 of the lock arm 66 is displaced to the completely-retaining projection 45, so that the female and male connectors 61 and 62 are locked to each other.

Therefore, in the female and male connectors 61 and 62 of this embodiment, as described above for the female and male connectors 1 and 2 of the preceding embodiment, when the slider 70 is returned to the lock position. The housing lock 67 of the lock arm 66 is displaced from the provisionally-retaining projection 41 to the completely-retaining projection 45, thereby switching the retained condition. Therefore, in a half-fitted condition in which the slider 70 can not be returned to the lock position, the housing lock 67 of the lock arm 66 is kept engaged with the provisionally-retaining projection 41 having the smaller retaining force than the completely-retaining projection 45 has, and therefore the force, required for moving the female and male connectors 61 and 62, half fitted together, away from each other to disconnect the two from each other, can be reduced. Thus, similar effects as described above for the female and male connectors 1 and 2 of the preceding embodiment can be achieved.

In the half-fitting prevention connector of the present invention, at the initial stage of the connector fitting operation, the slider, mounted on the one connector, abuts against the other connector, and is pushed to the non-lock position against the bias of the spring member. If this pushing operation is stopped in this half-fitted condition, the two connectors are returned or moved away from each other (that is, in the disconnecting direction opposite to the fitting direction) by the resilient force of the spring member, and therefore such a half-fitted condition can be easily detected.

Then, when the amount of fitting of the two connectors relative to each other reaches a predetermined value, the engagement portion of the lock arm, formed on the one connector, engages the provisionally-retaining portion, and also the engagement of the slider with the other connector is canceled, so that the slider begins to be returned to the lock position near to the distal end of the lock arm under the influence of the spring member.

Then, when the two connectors are fitted together, so that the slider is returned to the lock position, the slider displaces the engagement portion of the lock arm to the completely-retaining portion, and therefore the engagement portion of the lock arm is retained by the completely-retaining portion, so that the two connectors are locked to each other.

If the two connectors are incompletely fitted together, so that the slider can not be returned to the lock position, the engagement portion of the lock arm is not displaced to the completely-retaining portion, but is kept engaged with the provisionally-retaining portion having the retaining force smaller than that of the completely-retaining projection. Therefore, the required force, produced by the spring member so as to move the two connectors away from each other through the slider to disconnect the two from each other, can be reduced as compared with the case where the engagement portion of the lock arm is retained by the completely-retaining portion.

Namely, the spring member for moving the two connectors away from each other through the slider can be designed to produce a small resilient force, and even in this case, when there develops an incompletely-fitted condition in which the slider can not be returned to the lock position, the two connectors, half fitted together, can be moved away from each other by the resilient force of the spring member to such an extent that they are disconnected from each other, and the incompletely-fitted condition of the two connectors is positively prevented.

Therefore, the resilient force of the spring member is kept to a small value, and by doing so, the force, required for fitting the two connectors together, can be reduced, and the operating for fitting the two connectors together can be carried out easily.

What is claimed is:

1. A half-fitting prevention connector, comprising:

a first connector and a second connector fittable to each other, the connectors including housings, respectively;

a spring member receivable in the housing of said first connector;

a slider receivable in the housing of said first connector;

a lock arm provided in the housing of said first connector, the lock arm having an engagement portion;

wherein a half-fitted condition of the connectors is prevented by a resilient force of the spring member, and when said first connector is to be fitted relative to said second connector, the slider cooperates with the spring member to move between a lock position where the slider causes the lock arm to be engaged with the housing of said second connector and a non-lock position;

a completely-retaining portion which retains the engagement portion of the lock arm, the completely-retaining portion being formed on the housing of said second connector; and a provisionally-retaining portion which retains the engagement portion with a retaining force smaller than that of the completely-retaining portion, the provisionally-retaining portion being formed on the housing of said second connector, wherein the completely-retaining portion and the provisionally-retaining portion are juxtaposed to each other in a direction of a width of the housing of said second connector, wherein the width direction is perpendicular to the engaging direction of said first and second connectors, and wherein, when the slider is moved to the lock position in a completely locked position, the slider deforms the lock arm in the direction of the width of the housing so as to displace the engagement portion of the lock arm from the provisionally-retaining portion of the completely-retaining portion.

2. The half-fitting prevention connector of claim 1, wherein the lock arm extends in such a manner that the lock arm is inclined and moved in the direction of the width of the housing so that the engagement portion can advance onto the provisionally-retaining portion while said first and second connectors are engaging, and the slider includes an arm correcting portion which corrects the inclination of the lock arm in the direction of the width of the housing when the slider is moved to the lock position, thereby displacing the engagement portion of the lock arm to the completely-retaining portion.

3. The half-fitting prevention connector of claim 2, further comprising a guide step portion which guides the engagement portion of the lock arm to the provisionally-retaining portion while said first and second connectors are engaging, the guide step portion is formed on a side of the completely-retaining portion toward a front side of said second connector.

4. The half-fitting prevention connector of claim 1, wherein the lock arm extends in such a manner that the engagement portion advances onto the completely-retaining portion while said first and second connectors are engaging, and the slider includes an arm pressing portion which presses a slanting side surface of the lock arm in the direction of the width of the housing when the slider is moved from the lock position to the non-lock position, thereby displacing the engagement portion of the lock arm to the provisionally-retaining portion.

5. The half-fitting prevention connector of claim 4, further comprising a guide step portion which guides the engagement portion of the lock arm to the provisionally-retaining portion while said first and second connectors are engaging, the guide step portion is formed on a side of the completely-retaining portion toward a front side of said second connector.

* * * * *